US008640676B2

(12) United States Patent
Horiba et al.

(10) Patent No.: US 8,640,676 B2
(45) Date of Patent: Feb. 4, 2014

(54) EVAPORATED FUEL TREATMENT APPARATUS

(75) Inventors: Ayumu Horiba, Saitama (JP); Masakazu Kitamoto, Saitama (JP); Junji Saiga, Saitama (JP); Yoshikazu Kaneyasu, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 516 days.

(21) Appl. No.: 13/044,636

(22) Filed: Mar. 10, 2011

(65) Prior Publication Data

US 2011/0220071 A1 Sep. 15, 2011

(30) Foreign Application Priority Data

Mar. 11, 2010 (JP) ..... 2010-053962
Jun. 9, 2010 (JP) ..... 2010-131734

(51) Int. Cl.
*F02M 33/02* (2006.01)

(52) U.S. Cl.
USPC ..... 123/520; 123/518; 123/516

(58) Field of Classification Search
USPC ..... 123/516, 517, 518, 519, 520
See application file for complete search history.

(56) References Cited

U.S. PATENT DOCUMENTS 5,636,617 A * 6/1997 Nakatsu ..... 123/519
5,687,697 A * 11/1997 Ishikawa ..... 123/520
5,954,034 A * 9/1999 Takagi ..... 123/520
6,338,336 B1 * 1/2002 Iida ..... 123/674
6,698,280 B1 * 3/2004 Iden et al. ..... 73/114.39
6,829,921 B2 * 12/2004 Isobe et al. ..... 73/49.7
7,213,584 B2 5/2007 Ohhashi et al.
7,900,653 B2 3/2011 Zambonin et al.
8,095,292 B2 * 1/2012 McLain et al. ..... 701/103
8,104,453 B2 * 1/2012 Kobayashi ..... 123/519
2001/0010219 A1 * 8/2001 Isobe et al. ..... 123/516
2010/0224171 A1 * 9/2010 Peters et al. ..... 123/520
2010/0327205 A1 * 12/2010 Tan ..... 251/315.01

FOREIGN PATENT DOCUMENTS

JP 10-266908 A 10/1998
JP 2001-140705 A 5/2001
JP 1637267 A 7/2005
JP 2005-248911 A 9/2005
JP 2010-048196 A 3/2010
WO 2007/030960 A1 3/2007

* cited by examiner

*Primary Examiner* — Willis R Wolfe, Jr.
*Assistant Examiner* — Anthony L Bacon
(74) *Attorney, Agent, or Firm* — Carrier Blackman & Associates, P.C.; Joseph P. Carrier; William D. Blackman

(57) ABSTRACT

An evaporated fuel treatment apparatus includes a control valve having a dead zone range in which an evaporated fuel is blocked even if the opening angle is increased from a close position in opening direction and a communicating range in which the evaporated fuel is allowed to flow therethrough when opening angle is increased from the dead zone range. A control unit determines whether the opening angle is switched between the dead zone range and the communicating range. The switching is determined on the basis of a pressure inside the fuel tank detected with a pressure sensor and an air-fuel ratio detected by an air-fuel ratio sensor. A control valve installed in a communication path between a fuel tank and a canister is prevented from being seized.

15 Claims, 10 Drawing Sheets

IN FUELING

IN CS-MODE TRAVELING (PURGING)

OPENING ANGLE a = 0°

0<a<Bmax(a⊂B)

0<a=Bmax(a⊂B)

Bmax<a(a⊄B)

Bmax<a=90° (a⊄B)

EVAPORATED FUEL TREATMENT APPARATUS

CROSS REFERENCE TO RELATED APPLICATION

This application claims the foreign priority benefit under Title 35, United States Code, §119(a)-(d) of Japanese Patent Applications No. 2010-053962 filed on Mar. 11, 2010 and No. 2010-131734 on Jun. 9, 2010 in the Japan Patent Office, the disclosures of which are herein incorporated by reference in their entirety.

BACKGROUND OF THE INVENTION

1. Field of the Invention

The present invention relates to an evaporated fuel treatment apparatus which has a canister for adsorbing an evaporated fuel produced in a fuel tank and which treats the evaporated fuel.

2. Description of the Related Art

Conventional evaporated fuel treatment apparatuses cause a canister to adsorb an evaporated fuel, thereby preventing the evaporated fuel produced in the fuel tank from being released to the atmosphere at the time of fuel charging. Thus, a pressure of the fuel tank is reduced (see, for example, JP 2001-140705A).

According to the conventional evaporated fuel treatment apparatuses, the control valve is provided at a vapor path between the fuel tank and the canister, the control valve is opened prior to fuel charging in order to allow the canister to adsorb the evaporated fuel in the fuel tank through the control valve, thereby reducing the pressure inside the fuel tank. Reduction of the pressure prevents the evaporated fuel from being released to the atmosphere during fueling.

According to the conventional evaporated fuel treatment apparatuses, the canister becomes able to adsorb the evaporated fuel upon opening of the control valve. As the control valve a control valve capable of changing a flow rate therethrough by a duty control has been used.

SUMMARY OF THE INVENTION

The present invention may provide an evaporated fuel treatment apparatus which uses a control valve with a dead zone range in an opening angle thereof such as a ball valve having a dead zone and an open zone in the opening angle.

The present invention may provide an evaporated fuel treatment apparatus capable of detecting shift or switching in opening angle between a dead zone range and an open range.

The present invention may provide a method of preventing the control valve provided at a communication path between the fuel tank and the canister from being seized.

A first aspect of the present invention provides an evaporated fuel treatment apparatus for a vehicle comprising:

a fuel tank configured to store a fuel;

a canister configured to adsorb evaporated fuel in the fuel tank;

a control valve, installed at a vapor path communicating with the fuel tank and the canister, including a valve element; and a control unit configured to perform opening control on the control valve, wherein the control valve has a dead-zone range in an opening angle of the valve element where a flow of the evaporated fuel is blocked even when the opening angle of the control valve is increased in an open direction from an initial position.

According to this configuration, a valve having the dead zone range such as a ball valve can be used as the control valve.

A second aspect of the present invention provides an evaporated fuel treatment apparatus for a vehicle based on the first aspect, wherein the control unit determines whether the opening angle is switched between the dead zone range and a communicating range where the opening angle is greater than any of the opening angle in the dead zone range.

According to this aspect, switching between the dead zone range and communicating range of the control valve can be detected.

A third aspect of the present invention provides an evaporated fuel treatment apparatus for a vehicle based on the second aspect further comprising a pressure sensor configured to detect a pressure inside the fuel tank, wherein the control unit determines whether the opening angle is switched between the dead zone range and the communicating range on the basis of the detected pressure.

A fourth aspect of the present invention provides the evaporated fuel treatment apparatus for a vehicle based on the third aspect, wherein the control unit determines that the opening angle is switched from the dead zone range to the communicating range when the pressure inside the fuel tank begins to decrease while the opening angle is increased in an opening direction of the control valve from the dead zone range.

A fifth aspect of the present invention provides the evaporated fuel treatment apparatus for a vehicle based on the fourth aspect, wherein the control unit determines that the opening angle is switched from the communicating range to the dead zone range when the pressure inside the fuel tank become constant while the opening angle is decreased in a closing direction of the control value from the communicating range.

A sixth aspect of the present invention provides the evaporated fuel treatment apparatus for a vehicle based on the fifth aspect, wherein the control unit decreases the opening angle in the closing direction of the control value from the communicating range at a first speed which is smaller than a second speed at which the control unit increases the opening angle in the opening direction of the control valve from the dead zone range.

A seventh aspect of the present invention provides the evaporated fuel treatment apparatus for a vehicle based on the second aspect, further comprising an air-fuel mixture ratio sensor configured to detect an air-fuel ratio of an air-fuel mixture including the evaporated fuel, wherein the control unit determines whether the opening angle is switched between the dead zone range and the communicating range on the basis of the detected air-fuel ratio.

According to this aspect, switching between the dead zone range and the communicating range can be detected.

An eighth aspect of the present invention provides the evaporated fuel treatment apparatus for a vehicle based on the seventh aspect, wherein the control unit determines that the opening angle is switched from the dead zone range to the communicating range when the air-fuel ratio decreases by a quantity greater than a predetermined quantity while the opening angle is increased in an opening direction of the control valve from the dead zone range.

A ninth aspect of the present invention provides the evaporated fuel treatment apparatus for a vehicle based on the second aspect, further comprising an opening angle detecting unit configured to detect an opening angle of the control valve and a storage configured to store the opening angle detected by the opening angle detecting unit when the control unit determines whether the opening angle is switched between the dead zone range and the communicating range.

A tenth aspect of the present invention provides the evaporated fuel treatment apparatus for a vehicle based on the first aspect, wherein the control unit operates the control valve in the dead zone range when the vehicle is in a predetermined condition.

According to this aspect, the control valve is prevented from being seized.

An eleventh aspect of the present invention provides the evaporated fuel treatment apparatus for a vehicle based on the first aspect, wherein the control unit operates the control valve in the dead zone range when an ignition switch of the vehicle is turned on.

According to this aspect, the seizure prevention is done whenever the ignition switch of the vehicle is turned on.

A twelfth aspect of the present invention provides the evaporated fuel treatment apparatus for a vehicle based on the tenth aspect, wherein the control unit operates the control valve in the dead zone range when a driving force source of the vehicle is started up.

According to this aspect, the seizure prevention is done whenever a driving force source of the vehicle is started up.

A thirteenth aspect of the present invention provides the evaporated fuel treatment apparatus for a vehicle based on the tenth aspect, wherein the evaporated fuel is not adsorbed when the opening angle is in the dead zone range.

According to this aspect, the seizure prevention control can be done in a range where the purge path is not communicated through the control valve.

A fourteenth aspect of the present invention provides the evaporated fuel treatment apparatus for a vehicle based on the tenth aspect, wherein the control valve comprises a ball valve.

According to this aspect, the control valve can be operated surely.

A fifteenth aspect of the present invention provides the evaporated fuel treatment apparatus for a vehicle based on the tenth aspect, further comprising an opening angle detecting unit configured to detect an open angle of the control valve.

According to this aspect, the seizure prevention control can be done with an actual opening angel detected by opening angle detecting unit.

A sixteenth aspect of the present invention provides the evaporated fuel treatment apparatus for a vehicle based on the tenth aspect, wherein the vehicle comprises a plug-in hybrid vehicle.

According to this aspect, the seizure prevention can be preferably done.

DETAILED DESCRIPTION OF THE PREFERRED EMBODIMENTS

Figure 1:
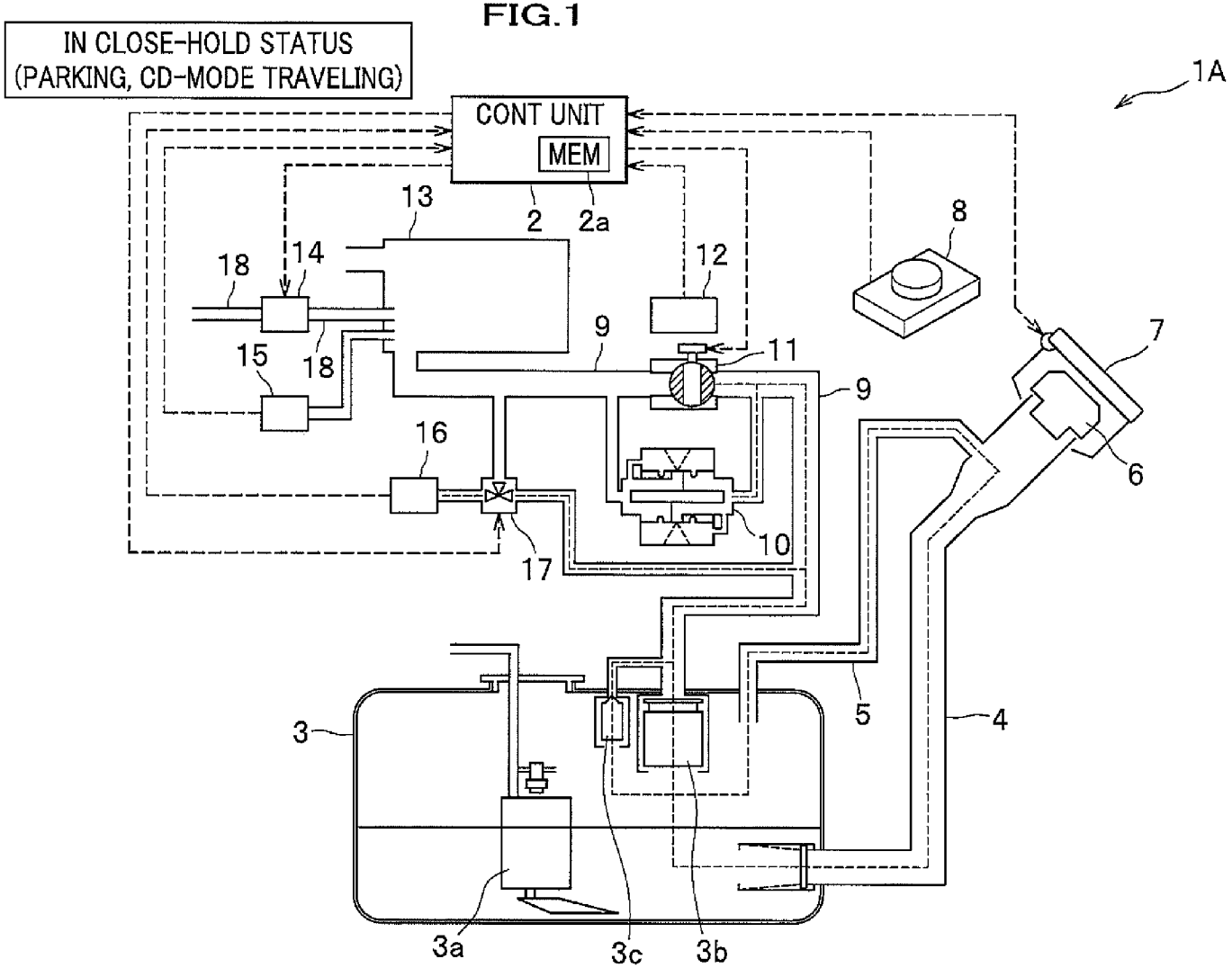
FIG. 1 is a diagram showing a configuration of an evaporated fuel treatment apparatus according to first and second embodiments of the present invention (at the time of a close-hold status)

Embodiments of the present invention will be explained in detail with reference to the accompanying drawings as needed. In each drawing, the same structural element will be denoted with the same reference numeral, and the duplicated explanation thereof will be omitted.

First Embodiment

FIG. 1 is a diagram showing a configuration of an evaporated fuel treatment apparatus 1 (at the time of maintaining a closed status) according to first embodiment of the present invention.

The evaporated fuel treatment apparatus 1 comprises a vapor path (a piping) 9, a fuel tank 3 for storing a fuel; a canister 13 for adsorbing an evaporated fuel (vapor), a control valve (a ball valve) 11 connected to the pipes in the vapor path 9, a high-pressure two-way valve 10 connected to pipes in the vapor path 9 in parallel with the control valve 11, an opening angle detecting unit (an encoder) 12 which detects a rotation angle (an open degree) of the control valve 11, a canister 13 to which one end of the vapor path 9 is connected, a purging path (a piping) 18 having one end connected to the canister 13 and having another end connected to an intake path (not shown) of an internal combustion engine, a purging control valve 14 connected to pipes of the purging path (the piping) 18, a pressure sensor 15 that detects a pressure inside the canister 13, a three-way valve 17, a pressure sensor 16 that detects a pressure at the side of a fuel tank 3 and a pressure at the canister side relative to the control valve 11 in the vapor path 9 by changing the direction of the flow of gas by the three-way valve 17, and a control unit 2.

The vapor path 9 has another end connected to the fuel tank 3. An end of a filler pipe 4 and an end of a breather pipe 5 are connected to the fuel tank 3. The breather pipe 5 has another end connected to the upper part of the filler pipe 4. The filler pipe 4 has another end plugged off by a filler cap 6.

A fuel lid 7 further covers the filler cap 6. When a driver, etc., pushes a lid switch 8, and when the control unit 2 determines that a predetermined condition is satisfied, the control unit 2 opens the fuel lid 7. When the fuel lid 7 is opened, the driver, etc., can remove the filler cap 6, and a fuel charging to the fuel tank 3 is enabled.

The fuel tank 3 comprises a pump 3*a* that feeds a fuel to the internal combustion engine (not shown), a float valve 3*b* and a cut valve 3*c* both provided at an opening to the vapor path 9. The float valve 3*b* blocks off the opening to the vapor path 9 when the fuel tank 3 becomes full, thereby preventing the fuel from entering into the vapor path 9. The cut valve 3*c* does not block off the opening to the vapor path 9 when the fuel tank 3 becomes full, but for example, when the fuel tank 3 is tilted and the liquid level of the fuel ascends, the cut valve 3*c* prevents the fuel from entering into the vapor path 9.

The canister 13 is able to adsorb an evaporated fuel produced in the fuel tank 3 reserving the fuel. The canister 13 has an activated charcoal, etc., there inside, which adsorbs the evaporated fuel. On the other hand, the canister 13 suctions air, and feeds the suctioned air to the purging path (the piping) 18, thereby purging the evaporated fuel adsorbed in the canister 13 to the internal combustion engine out of the canister 13.

The control valve 11 is provided at the vapor path 9 communicating the fuel tank 3 and the canister 13 with each other. An example of the control valve 11 is a ball valve. It will be explained in more detail later but a ball valve is fully closed when the opening angle thereof becomes zero, has a dead zone (invariable zone) where communication is blocked off around the opening angle of zero, and is fully opened when the opening angle thereof becomes 90 degrees.

The control valve 11 is controlled by an open instruction signal from a control unit 2 to a given opening angle. The opening angle of the control valve (the ball valve) 11 can be detected by the opening angle detecting unit 12, and the detected opening angle is transmitted to the control unit 2. The control unit 2 can perform both opening control of opening the control valve 11 and closing control of closing the control valve 11.

The high-pressure two-way valve 10 is a mechanical valve that is a combination of diaphragm-type positive and negative pressure valves. The positive pressure valve is configured to be opened when the pressure at the fuel-tank side becomes higher than the pressure at the canister side by a predetermined pressure. Opening of this valve causes the high-pressure evaporated fuel in the fuel tank 3 to be fed to the canister 13. The negative pressure valve is configured to be opened when the pressure at the fuel-tank side becomes lower than the pressure at the canister side by a predetermined pressure. Opening of this valve causes the evaporated fuel retained in the canister 13 to be returned to the fuel tank 3.

Accordingly, when the fuel tank 3 maintained in a closed status at the time of "parking" and at the time of "CD MODE driving" excessively becomes a high pressure or a low pressure, the high-pressure two-way valve 10 is opened, thereby adjusting the internal pressure of the fuel tank 3.

The purging control valve 14 is provided at the purging path (the piping) 18. An example of the purging control valve 14 available is an electromagnetic valve. The purging control valve 14 is subjected to an opening control and a closing control by the control unit 2.

The purging path 18 is connected to an engine (internal combustion engine). The control unit 2 supplies the evaporated fuel purged by opening the purge control valve 14.

Examples of the pressure sensors 15, 16 are each a piezoelectric device. The pressure sensor 15 is connected to the canister 13, and is able to detect a pressure inside the canister 13. Because the pressure inside the canister 13 becomes equal to a pressure inside the purging path 18 and a pressure at the canister-side relative to the control valve 11 in the vapor path 9, the pressure sensor 15 can substantially detect those pressures. Detected pressure is transmitted to the control unit 2.

The pressure sensor 16 is connected to an opening of the three-way valve 17. The other two openings of the three-way valve 17 are connected to the canister side of the vapor path 9 with respect to the control valve 11 and the fuel-tank side of the vapor path 9 with respect to the control valve 11, respectively. The control unit 2 controls the three-way valve 17 in order to connect the pressure sensor 16 to the canister side of the vapor path 9 (communication status) with respect to the control valve 11, or connect the pressure sensor 16 to the fuel-tank side of the vapor path 9 (switches communication status of the three-way valve 17) with respect to the control valve 11. When the pressure sensor 16 is connected to the canister side of the vapor path 9 with respect to the control valve 11, the pressure sensor 16 can detect a pressure at the canister side in the vapor path 9 with respect to the control valve 11, and also a pressure inside the canister 13.

A pressure detected at this time is consistent with a pressure detected by the pressure sensor 15 when the same location is measured, so that the pressure sensors 15, 16 can be calibrated and a failure diagnosis can be enabled. When the three-way valve 17 is controlled and the pressure sensor 16 is connected to the fuel-tank side of the vapor path 9 with respect to the control valve 11, the pressure sensor 16 can detect a pressure at the fuel-tank side in the vapor path 9 with respect to the control valve 11, and also a pressure inside the fuel tank 3. The pressure sensor 16 transmits the detected pressure to the control unit 2.

<<Valve Opening and Closing Control>>

With reference to FIGS. 1 to 3, and 11, a control of an evaporated fuel treatment apparatus 1A will be described, wherein a plug-in hybrid vehicle 30 is exemplified for the embodiments of the present invention.

Figure 2:
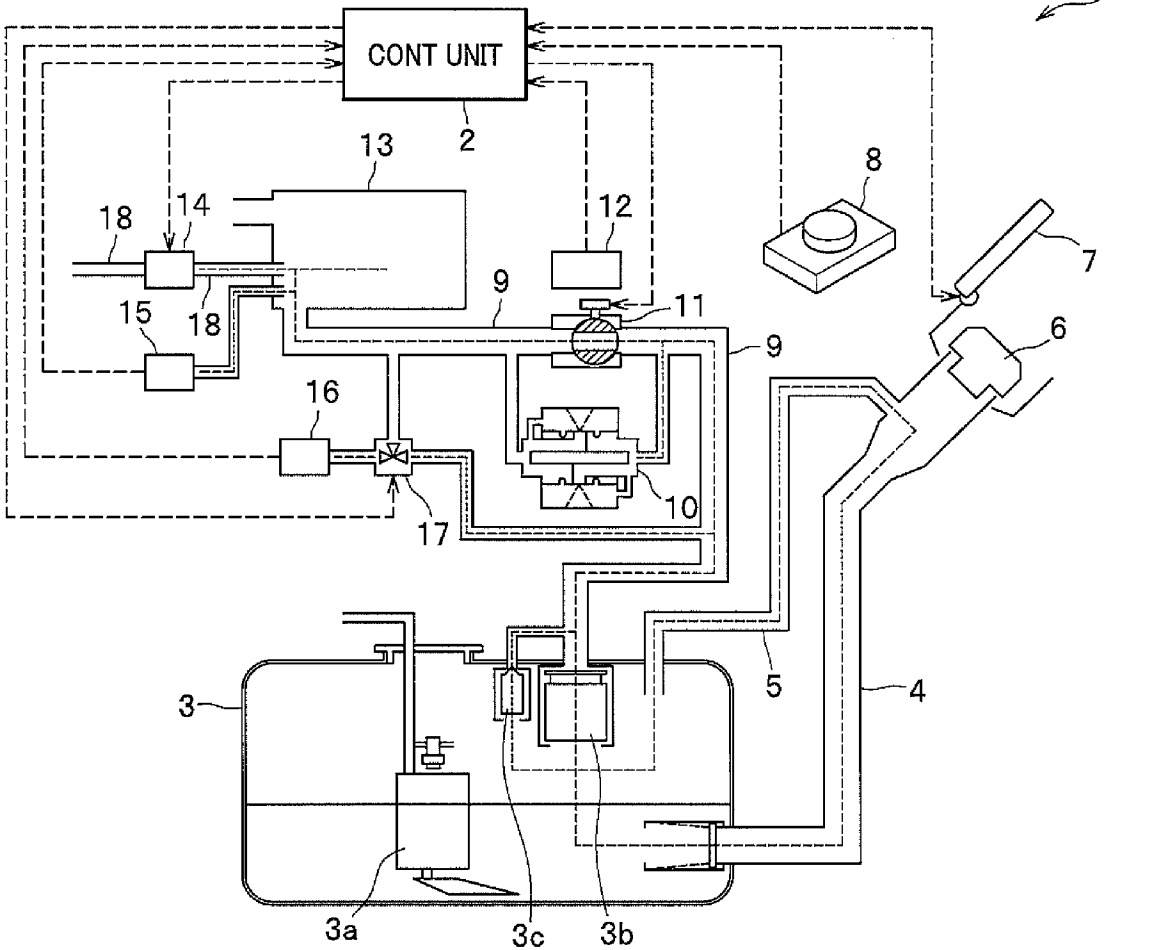
FIG. 2 is a diagram showing the configuration of the evaporated fuel treatment apparatus according to first and second embodiments of the present invention (at the time of fueling)
Figure 3:
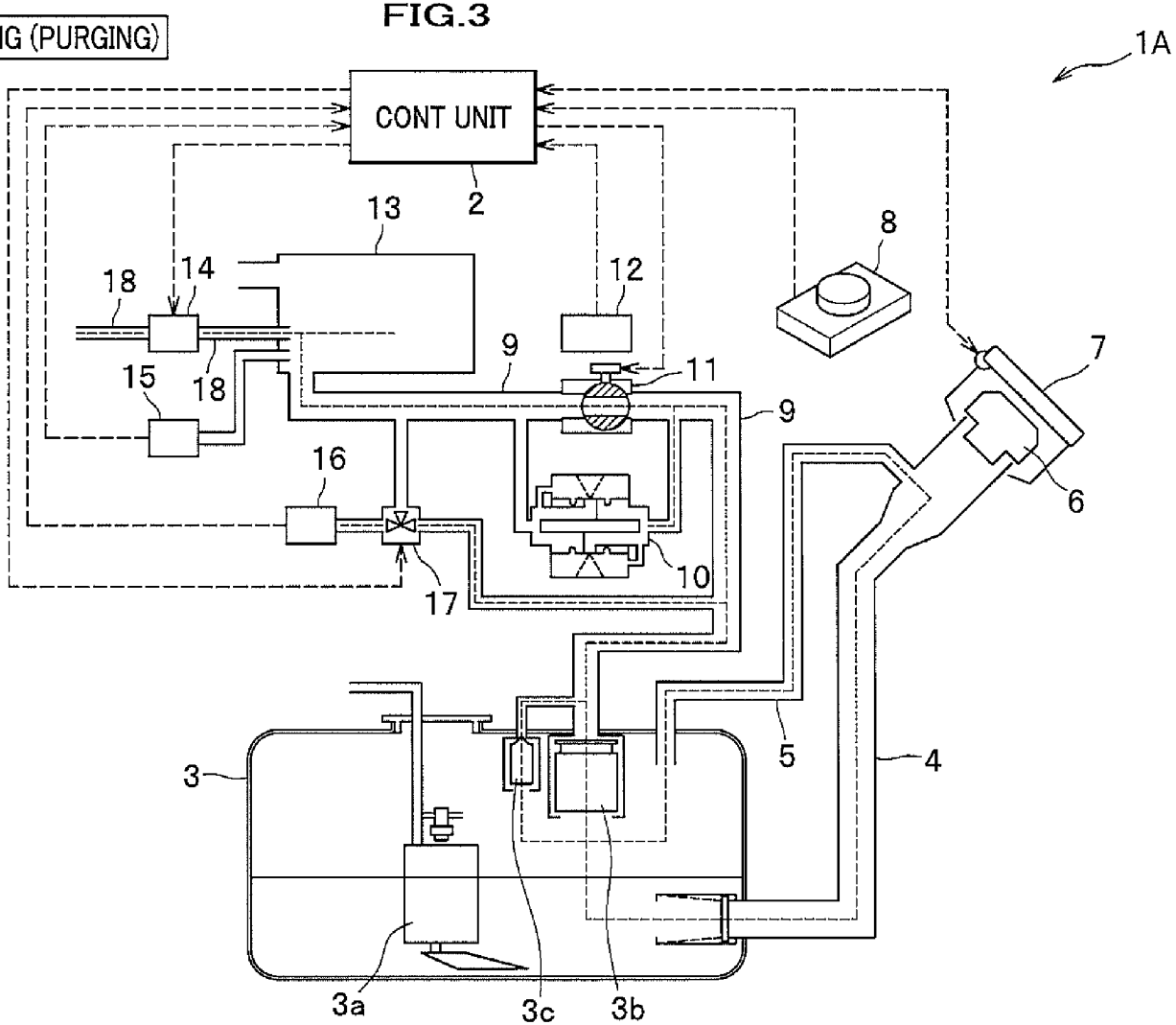
FIG. 3 is a diagram showing the configuration of the evaporated fuel treatment apparatus according to first and second embodiments of the present invention to show a status of a CS MODE traveling (purging)

FIG. 1 shows a status of parking, and a CD MODE traveling (close-hold status). FIG. 2 shows fueling status. FIG. 3 shows a status of CS MOE traveling (in purging). "CD MODE traveling" is a status in which an ending (internal combustion engine) is driven in a hybrid (HEV) traveling mode.

As shown in FIG. 2, the control unit 2 opens the purge control valve 14 and open the control valve 11 in fueling, so that the evaporated fuel (vapor) is adsorbed by the canister 13 to prevent evaporated fuel vapor) from leaking through the fuel lid 7.

In addition, as shown in FIG. 3, the control unit 2 opens the purge control valve 14 and the control valve 11 to allow the evaporated fuel in the fuel tank and the evaporated fuel adsorbed by the canister 13 to flow to an intake manifold (not shown) of the engine through the purge path 18 to be burned in the engine.

On the other hand, as shown in FIG. 1, the control unit 2 closes the control valve 11 in parking and the CD MODE travailing (close-hold status) to prevent the evaporated fuel from being adsorbed by the canister 13.

<<Configuration of Control Valve>>

Figure 4A:
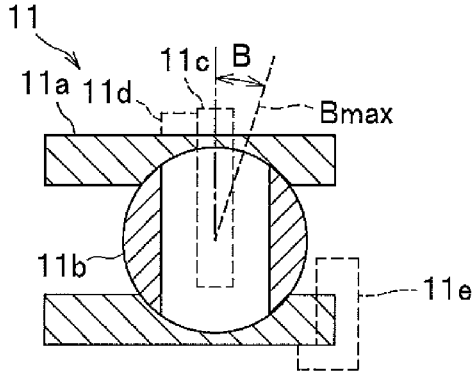
FIG. 4A is a cross-sectional view of cutting a ball (a valve element) of a control valve (a ball valve) used in the evaporated fuel treatment apparatus according to the first to third embodiments of the present invention with a plane having a normal line aligned with a rotation axis of the ball and shows a condition in which the opening angle (open degree) of the control valve is zero (fully closed)

FIGS. 4A to 4E are cross-sectional views of cutting a ball (a valve element) 11*b* of the control valve (the ball valve) 11 with a plane having a normal line aligned with the rotation axis of the ball. FIG. 4A shows a status in which an opening angle a of the control valve 11 is zero (fully closed).

When the opening angle a is zero (fully closed), with respect to the direction of the flow path in a valving seat 11*a*, the direction of the flow path in a ball 11*b* is inclined by 90 degrees, and the flow path in the valving seat 11*a* is blocked by the ball 11*b*. The valving seat 11*a* is provided with a fully closed stopper 11*d* and a fully opened stopper 11*e*, and the ball 11*b* is provided with a stem 11*c*. The stem 11*c* rotates together with a rotation of the ball 11*b*. When the opening angle a is zero (fully closed), the stem 11*c* abuts the fully closed stopper 11*d*, so that the ball 11*b* is prevented from rotating in the counterclockwise direction over the condition shown in FIG. 4A.

The control unit 2 performs closing control of rotating the ball 11*b* and the stem 11*c* until those become unable to rotate in the counterclockwise direction, and stores an opening angle a in the unrotatable status as a zero angle (zero point), thereby enabling a zero point correction of the opening angle a. Also, in a status in which the opening angle a is 90 degrees (fully opened), the stem 11*c* abuts the fully open stopper 11*e*, so that the ball 11*b* becomes unable to rotate in the clockwise direction over the condition shown in FIG. 4E.

FIGS. 4A to 4E show a status in which the ball 11*b* is rotated in the clockwise direction in order to open the valve, but the present invention is not limited to this condition, and the ball 11*b* may be rotated in the counterclockwise direction in order to open the valve. In this case, the position of the fully close stopper 11*d* and that of the fully open stopper 11*e* may be adjusted in accordance with a rotatable range of the ball 11*b* and that of the stem 11*c*.

The control valve (the ball valve) 11 has, in addition to the range where the opening angle is substantially zero and the control valve 11 is fully closed, a dead-zone range B where the opening angle is larger than substantial zero and the flow rate of the evaporated fuel becomes changeless relative to the opening angle. The dead-zone range B is a range where the vapor path 9 is not communicated therethrough by the control valve 11, and in the dead-zone range B, even if the opening angle of the control valve 11 is increased from the zero opening angle at the closed position to the open direction, the flow of the evaporated fuel is blocked. Accordingly, the evaporated fuel in the fuel tank 3 is not adsorbed by the canister 13. More specifically, in the dead-zone range B, no evaporated fuel flows and no evaporated fuel is adsorbed in the canister 13. When the opening angle becomes larger than the dead-zone range B, the flow of the evaporated fuel is permitted.

Figure 4B:
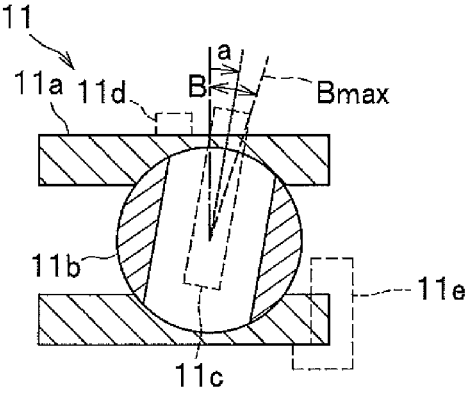
FIG. 4B is a cross-sectional view of cutting the ball of the control valve (the ball valve) used in the evaporated fuel treatment apparatus according to the first to third embodiments of the present invention with the plane having the normal line aligned with the rotation axis of the ball and shows a status in which the opening angle of the control valve is larger than zero but smaller than the maximum opening angle in a dead-zone range.

As shown in FIG. 4B, when the opening angle a is larger than zero but is smaller than a maximum opening angle Bmax in the dead-zone range B, like the case in which the opening angle a is zero, the flow path in the valve seat 11*a* is blocked by the ball (the valve element) 11*b*, so that the evaporated fuel cannot flow and pass through the control valve 11.

Figure 4C:
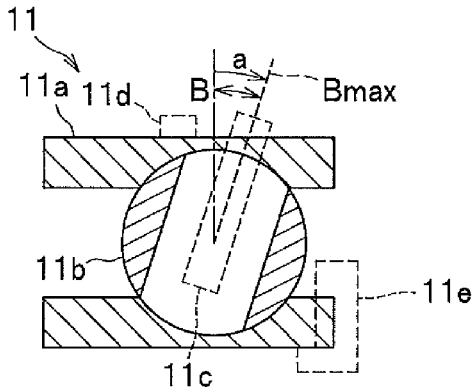
FIG. 4C is a cross-sectional view of cutting the ball of the control valve used in the evaporated fuel treatment apparatus according to the first to third embodiments of the present invention with the plane having the normal line aligned with the rotation axis of the ball and shows a status in which the opening angle of the control valve is equal to the maximum opening angle in the dead-zone range.

As shown in FIG. 4C, when the opening angle a is equal to the maxim opening angle Bmax of the dead-zone range B, the evaporated fuel cannot flow and pass through the control valve 11.

Figure 4D:
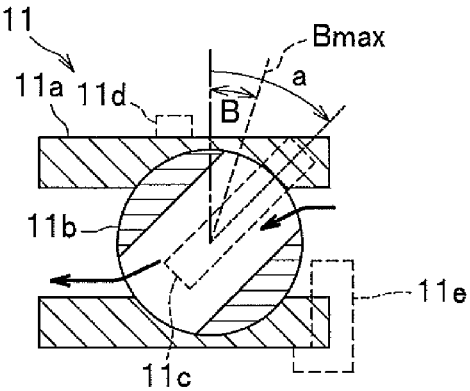
FIG. 4D is a cross-sectional view of cutting the ball of the control valve used in the evaporated fuel treatment apparatus according to the first to third embodiments of the present invention with the plane having the normal line aligned with the rotation axis of the ball and shows a status in which the opening angle of the control valve is larger than the maximum opening angle in the dead-zone range and is smaller than 90 degrees (fully opened)

As shown in FIG. 4D, when the opening angle a is larger than the maximum opening angle Bmax of the dead-zone range B but is smaller than 90 degrees (fully opened), the evaporated fuel can flow and pass through the control valve 11.

Figure 4E:
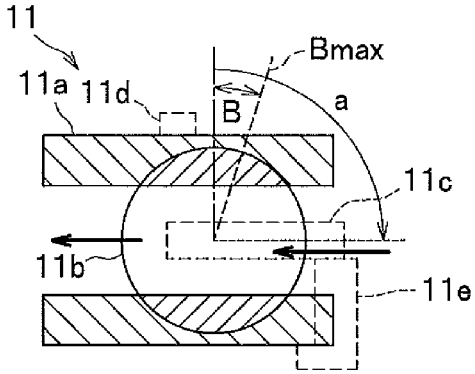
FIG. 4E is a cross-sectional view of cutting the ball of the control valve used in the evaporated fuel treatment apparatus according to the first to third embodiments of the present invention with the plane having the normal line that is the rotation axis of the ball and shows a status in which the opening angle of the control valve is equal to 90 degrees (fully opened)

As shown in FIG. 4E, when the opening angle a is equal to 90 degrees (fully opened), the direction of the flow path in the ball 11*b* matches the direction of the flow path in the valve seat 11*a*, so that the control valve 11 can allow the evaporated fuel to flow therethrough at a maximum flow rate. The stem 11*c* abuts the fully open stopper 11*e* to prevent the ball 11*b* from more rotating clockwise than the position shown in FIG. 4E.

As mentioned above, the evaporated fuel treatment apparatus of the first embodiment in which the valve having a dead zone is used as the control valve 11 according to the present invention.

Second Embodiment

Next, the evaporated fuel treatment apparatus of a second embodiment according to the present invention which determines whether a current position of the ball is in the dead zone and communicating zone. There is a difference between the first and second embodiments in that it is determined whether a current position of the ball is in the dead zone and communicating zone.

Figure 5:
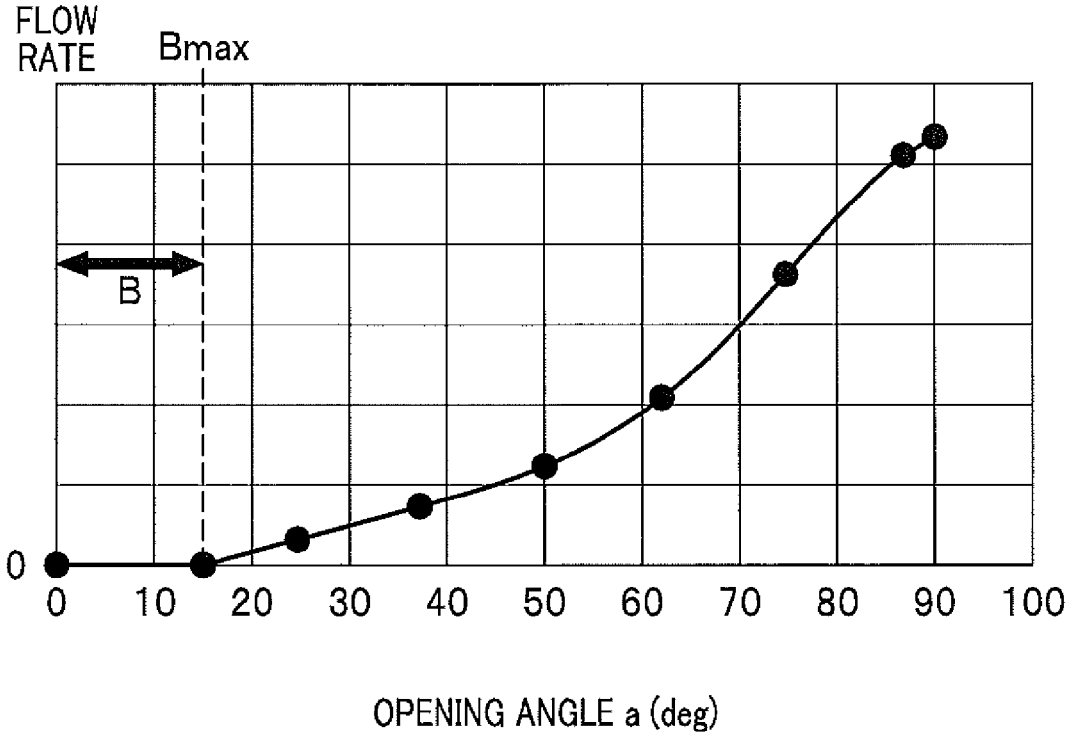
FIG. 5 is a graph showing a relationship between the opening angle of the control valve and the flow rate of the evaporated fuel flowing through the control valve.

FIG. 5 shows an example relationship between the opening angle a and the flow rate of the evaporated fuel through the control valve 11.

When the opening angle a is zero, the flow rate is zero. When the opening angle a exceeds zero and is up to 15 degrees, the flow rate is still zero. The range where the flow rate is zero and the opening angle a exceeds zero and is up to 15 degrees is the dead-zone range B. The opening angle a which is 15 degrees is a maximum opening angle Bmax of the dead-zone range B.

When the opening angle a exceeds the maximum opening angle Bmax that is 15 degrees, the flow rate becomes larger than zero, and up to 90 degrees, the larger the opening angle a becomes, the more the flow rate increases. The control unit 2 stores such a relationship of the flow rate relative to the opening angle a shown in the graph of FIG. 5, and in order to reduce the pressure inside the fuel tank 3 to a predetermined pressure within a predetermined time, calculates how much flow rate must be secured, and determines the opening angle a based on the calculated flow rate and the relationship of the flow rate relative to the stored opening angle a.

Because the flow rate changes depending on the pressure difference between the upstream side of the control valve 11 and the downstream side thereof, such a pressure difference may be taken into consideration at the time of determination of the opening angle a.

More specifically, the flow rate can be calculated in consideration of a pressure difference between upstream and down stream of the control valve 11 with the pressure sensors 15 and 16.

In addition, it has been described that the maximum opening angle Bmax in the dead zone range B of the control valve 11 is 15 degrees. However, the maximum opening angle Bmax can be changed by modifying a diameter of the ball 11*b* of the control valve 11 and a diameter of the flow path.

<<Learning of Max Opening Angle in Dead Zone Range of Control Valve>>

Next, a method of learning the maximum opening angle Bmax in the dead zone range B of the control valve 11 will be described with reference to FIGS. 6 and 7.

Figure 6:
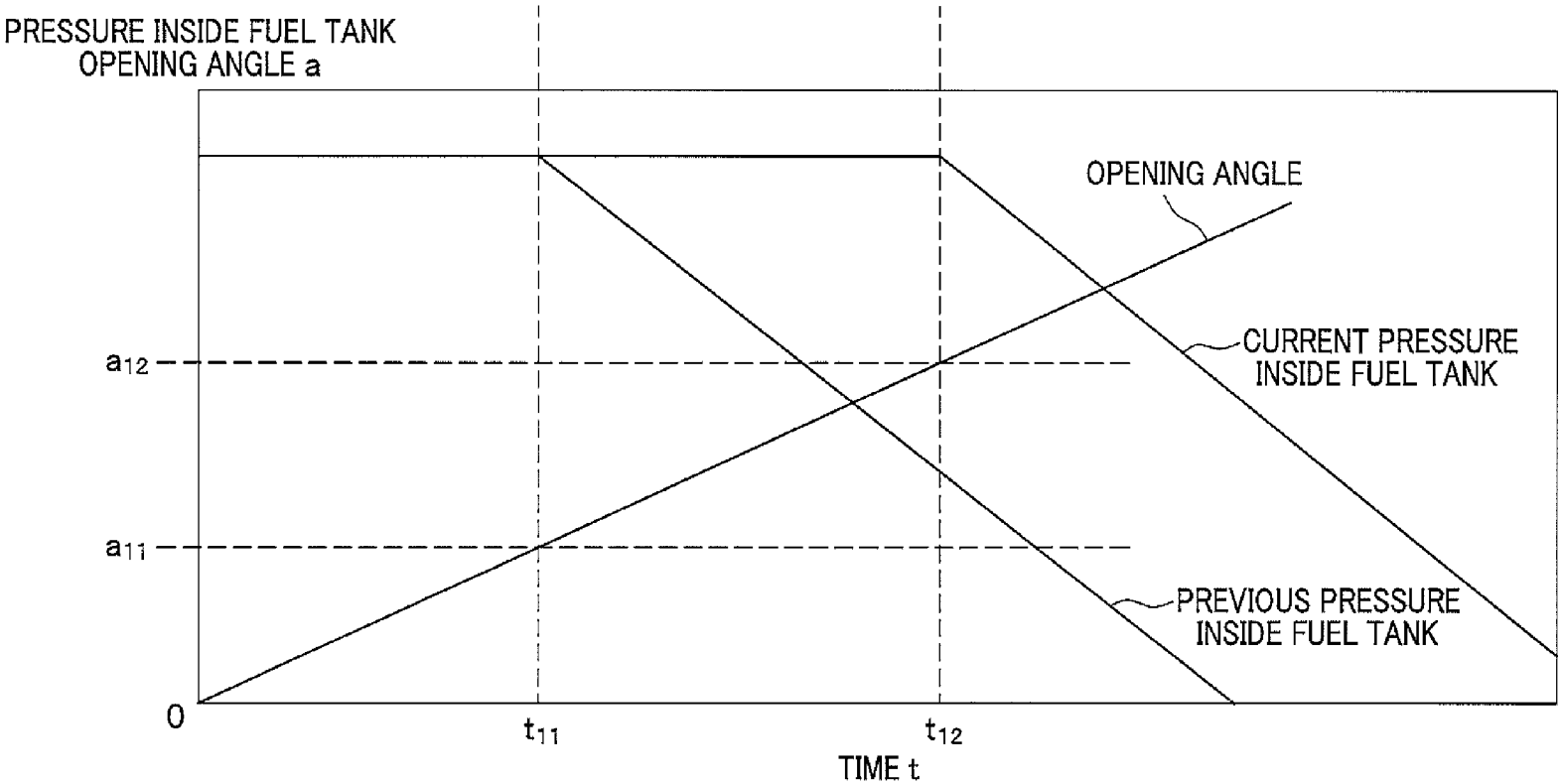
FIG. 6 is a chart showing a time variation in the opening angle of the control valve and an inner pressure of a fuel tank to learn a maximum opening angle of the dead zone of the control valve.
Figure 7:
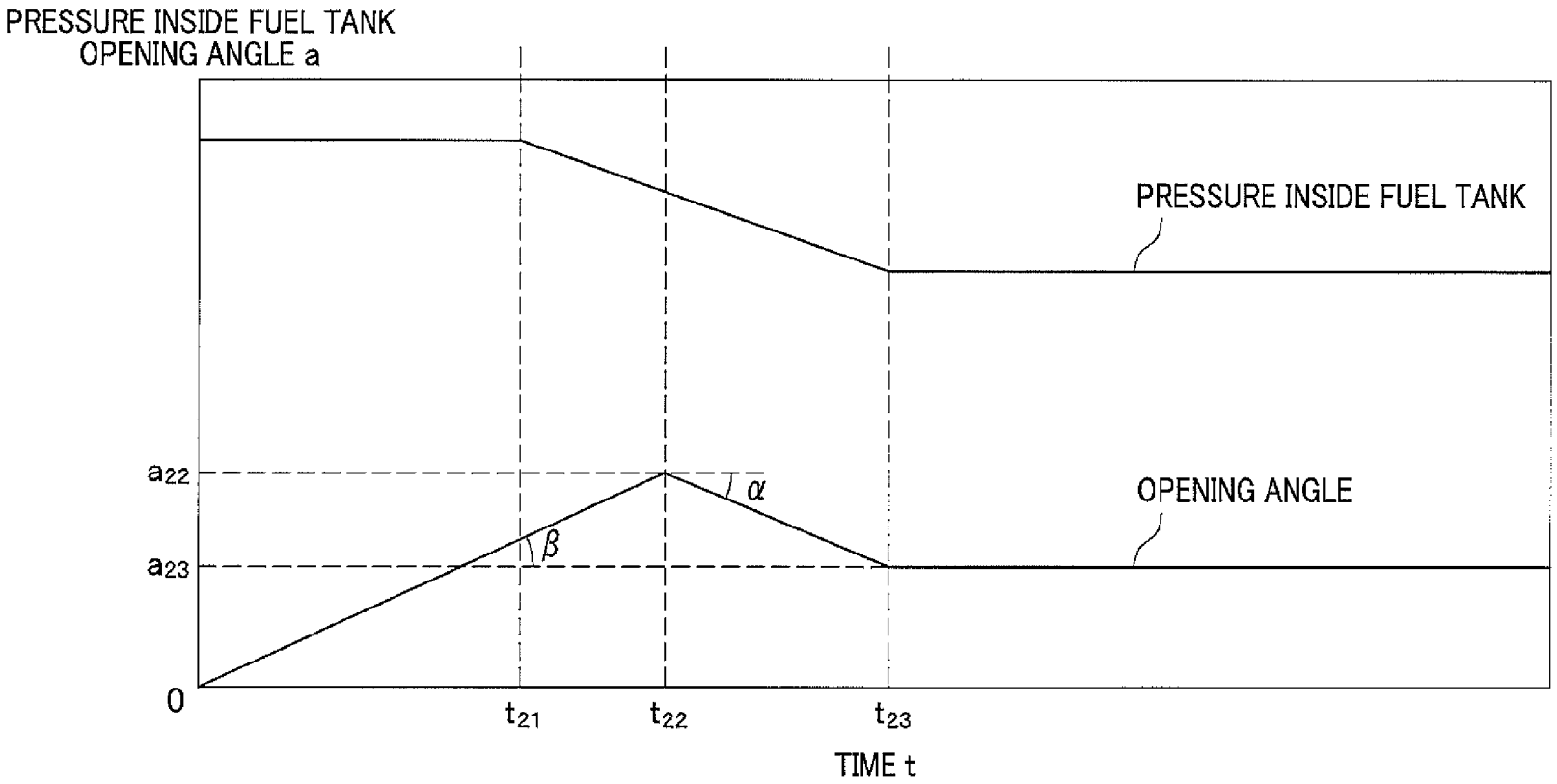
FIG. 7 is a chart showing a time variation in the opening angle of the control valve and an inner pressure of a fuel tank to learn a maximum opening angle of the dead zone of the control valve.

FIG. 6 shows an example in which the maximum opening angle Bmax in the dead zone of the control valve 11 shifts toward a larger value, and FIG. 7 shows an example in which the maximum opening angle Bmax in the dead zone of the control valve 11 shifts toward a smaller value.

For example, the control unit 2 can execute learning shown in FIGS. 6 and 7 at a predetermined learning period.

In the example shown in FIG. 6, the control unit 2 opens the control valve 11 by rotating the ball 11*b* of the control valve 11 at a predetermined speed (rotation speed) from a predetermined closed position (an initial position, for example, an opening angle of, for example, zero degrees). The chart in FIG. 6 shows a previous valve opening control in which the pressure inside the fuel tank 3 detected by the pressure sensor 16 began to decrease after a time t11 from a start (t=0) of opening the control valve 11. Thus, the control unit 2 determines that the control valve 11 is switched to a communicating range from the dead zone range at the time t11 and stores, in a storage (memory) 2*a* of the control unit 2, the pressure inside the fuel tank a11 as a maximum opening angle Bmax in the dead zone range B.

After that, the control unit 2 opens the control valve 11 similarly to the previous learning by rotating the ball 11*b* of the control valve 11 at a predetermined speed (rotational speed) from the opening angle a of a predetermined close position (the initial position, for example, zero degrees).

In the current valve opening control, because the pressure inside the fuel tank 3 detected by the pressure sensor 16 begins to decrease at time after time period of t12 (t12>t11) from the start of opening. Accordingly the control unit 2 determines that the control valve 11 is switched to the communicating range from the dead zone range at the time t12 and stores (updates) the pressure inside the fuel tank a12 as a maximum opening angle Bmax in the dead zone range B in the storage 2*a* in the control unit 2. The control unit 2 learned that the opening angle a of the maximum opening angle Bmax in the dead zone B (switch of the opening angle of the control valve 11 from the dead zone angle to the communicating zone) shifts to the opening angle a12 from a11.

On the other hand, in the example shown in FIG. 7, the control unit 2 opens the control valve 11 by rotating the ball 11*b* of the control valve 11 at a predetermined speed from the predetermined close position (initial position, for example, the opening angle a of zero).

In the example shown in FIG. 7, because the opening angle a of the control valve 11 reaches the maximum opening angle Bmax in the dead zone B at time t21 before the opening angle a reaches the maximum opening angle Bmax in the dead zone in the previous learning of the control valve 11, the pressure inside the fuel tank 3 begins to decrease.

After that, the opening angle a of the control valve 11 reaches an opening angle a22 which is the previous maximum opening angle Bmax in the dead zone range B at time t22 (=t11). The control unit 11 determines that the pressure inside the fuel tank 3 begins to decrease before the opening angle a reaches the maximum opening angle Bmax in the dead zone B previously stored. Then, the control unit 11 rotates the ball 11*b* of the control valve 11 in the reverse rotational direction to close the control valve 11. After a time period t23 from the start of the opening of the valve 11, the pressure inside the fuel tank 3 detected by the pressure sensor 16 finishes decreasing and the pressure becomes to be constant (variation of the pressure is lower than a predetermined value (substantially zero)). Accordingly the control unit 2 determines that the control valve 11 is switched from the communicating range to the dead zone range at time t23 and stores (updates) the opening angle a23 at time t23 in the storage 2*a* in the control unit 2. More specifically, the control unit 2 learned that the opening angle a of the control valve 11 is switched from the dead zone to the communicating zone) is shifted to the opening angle a 23 from the opening angle a22.

In addition, in the example shown in FIG. 7, the control unit 2 executes opening and closing control to make the speed of closing the control valve 11 (decreasing the opening angle in a closing direction from the communicating region from time t=0 to t22) smaller than the speed of opening the control valve 11 (a time period for increasing the opening angle in opening direction from the dead zone region. In other words, the control unit 3 decreases the opening angle in the closing direction of the control value from the communicating range at a first speed (corresponding to an angle $\alpha$ in FIG. 7) which smaller than a second speed (corresponding to an angle $\beta$ in FIG. 7) at which the control unit 11 increases the opening angle a in the opening direction of the control valve from the dead zone range. This increases a detection accuracy of the maximum opening angle Bmax in the dead zone B.

In addition, the learning method for the example shown in FIG. 7 is applicable to a case where the control valve 11 becomes in a communicating status due to shift of ball 11*b* in a status the control unit 2 has caused the control valve 11 to stand by at the maximum opening angle Bmax in the dead zone range B learned in the previous detection. More specifically, even if the control valve 11 becomes to be in the communicating range due to shift of the ball 11*b* by, for example, vibration in a status where the opening angle a of the control valve 11 is at the maximum opening angle Bmax in the dead zone range B at the previous detection, the control unit 2 determines that the pressure inside the fuel tank detected by the pressure sensor 16 begins to decrease and then closes the control valve 11 by rotating the ball 11*b* in the reverse direction. When the pressure inside the fuel tank 3 detected by the pressure sensor 16 becomes to be constant (in a status where a variation quantity of the pressure inside the fuel tank 3 is smaller than a predetermined value (nearly zero)) after finish of decrease in the pressure inside the fuel tank 3, the control unit 2 determines that the status of the control valve 11 is switched from the communicating range to the dead zone range B, and stores (updates) the pressure inside the fuel tank 3 as a value corresponding to the maximum opening angle Bmax in the dead zone range B in the storage 2*a*.

The evaporated fuel treatment apparatus 1A of the second embodiment according to the present invention can detect switch in the opening angle of the control valve 11 between the dead zone range and the communicating range. More specifically, when the shift occurs in timing of change of the status in the control valve 11 from the dead zone range B to the communicating range due to a position shift of the valve element 11*b* generated when the control valve 11 is closed, the evaporated fuel treatment apparatus 1A can recognize (detect a difference in previous value and the current value of) the maximum opening angle Bmax in the dead done range B after the shift in timing occurs. This prevents the evaporated fuel from being adsorbed by the canister 13 although the ball 11*b* of the control valve 11 is moved in the dead zone range B and can provide an accurate control the control valve 11 in a case where the control valve 11 is slightly opened during releasing the pressure.

Third Embodiment

Figure 8:
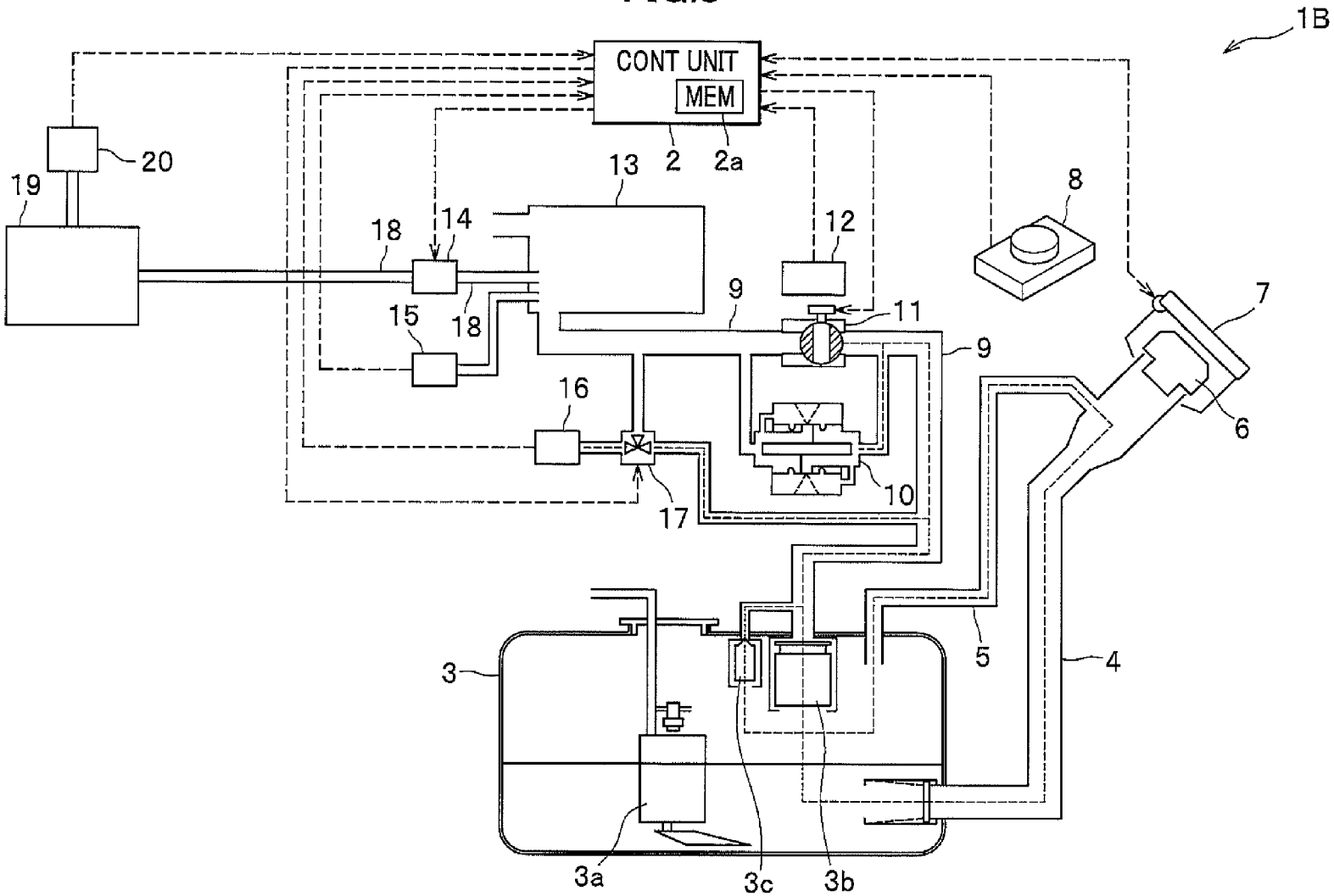
FIG. 8 is a diagram showing a configuration of an evaporated fuel treatment apparatus according to a third embodiment of the present invention.

Next, the evaporated fuel treatment apparatus of the third embodiment according to the present invention will be described mainly about the difference from the first and second embodiment 1A. As shown in FIG. 8, the evaporated fuel treatment apparatus 1B of the third embodiment further includes an engine (internal combustion engine) 19 supplied with the purged evaporated fuel as a mixture gas through the purge path 18 and an air-fuel ratio sensor 20 for detecting an air-fuel ratio of the fuel mixture (a value obtained by dividing a mass of the air by a mass of the evaporated fuel in the fuel mixture) and supplies a detection result to the control unit 2.

The air-fuel ratio sensor 20 comprises an $O_2$ sensor installed in an exhaust system (exhaust manifold, catalyst, a muffler, etc.) to detect the air-fuel ratio according to increase or decrease in a resistance of the $O_2$ sensor.

<<Learning Dead Zone Max Opening Angle of Control Valve>>

Figure 9:
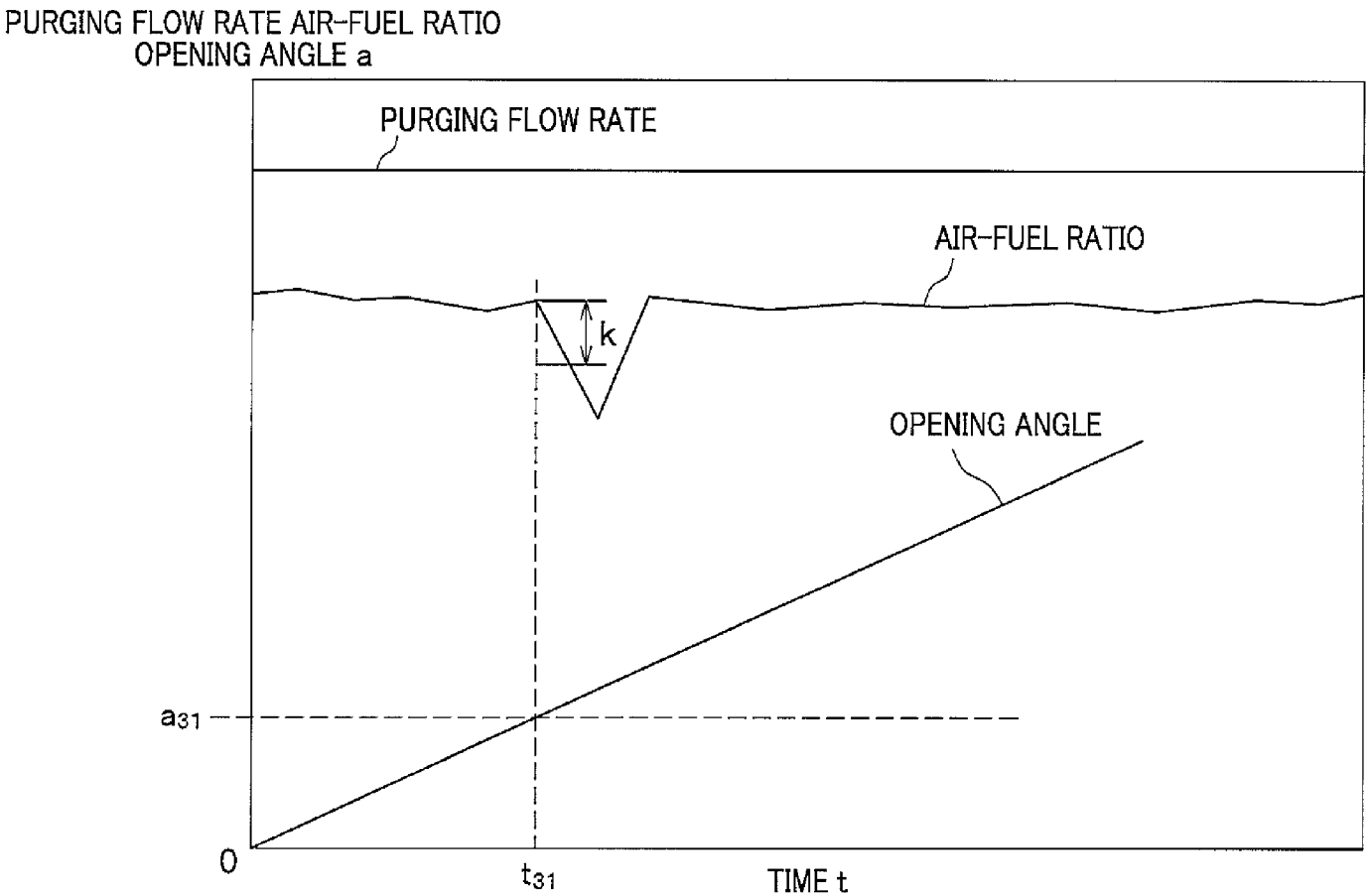
FIG. 9 is a chart showing a time variation in a purging flow rate of the evaporated gas, an air-fuel ratio, and the opening angle of the control valve for illustrating a method of learning a dead zone opening angle of the control valve.

With reference to FIG. 9 a method of learning the maximum opening angle Bmax in the dead zone range of the control valve 11 will be described. In an example shown in FIG. 9, the control unit 2 supplies the fuel mixture including the evaporated fuel after previously opening the purge control valve 14.

Next, after a quantity of the evaporated fuel purged toward the engine 19 becomes stable, the control unit 2 opens the control valve 11 by rotating the ball 11*b* of the control valve 11 at a predetermined speed (rotation speed) from a predetermined opening angle (for example, the opening angle a 0 (zero) degrees. In the chart shown in FIG. 9, after a time period t31 from start of the valve (t=0), because the air-fuel ratio detected by the air-fuel ratio sensor 20 more decreases than the predetermined value k, the control unit 2 determines that the status of the control valve 11 changes from the dead zone range to the communicating range at time t31 when the air-fuel ratio begins to decrease and stores the pressure a31 inside the fuel tank 3 as a value corresponding to a maximum opening angle Bmax in the dead zone range B in the storage (memory) 2*a* in the control unit 2. In addition, the control unit 2 executes a feedback control of the air-fuel ratio which adjusts a quantity of the evaporated fuel and a quantity of the air in the fuel mixture, so that the air-fuel ratio once decreased is returned to the original value.

The evaporated fuel treatment apparatus 1B of a third embodiment can detect switch in the opening angle of the control valve between the dead zone range and the communicating range on the basis of an air-fuel mixture ratio. More specifically, in the evaporated fuel treatment apparatus 1B, when a shift occurs in timing of change of the status in the control valve 11 from the dead zone range B to the communicating range due to, for example, a position shift of the valve element 11*b* generated when the control valve 11 is closed, the evaporated fuel treatment apparatus 1B can detect the maximum opening angle Bmax in the dead done range B after the shift in timing occurs. This prevents the evaporated fuel from being adsorbed by the canister 13 although the control unit 2 intends to move the ball 11*b* of the control valve 11 in the dead zone range B and can provide an accurate control the control valve 11 in a case that the control valve 11 is slightly opened during releasing the pressure.

As mentioned above, the evaporated fuel treatment apparatus of the third embodiment according to the present invention which uses the valve having the dead zone as the control valve 11 has been described.

Fourth Embodiment

Next, an explanation will be given of a seizure prevention method executed by an evaporated fuel treatment apparatus according to a fourth embodiment of the present invention.

<<Control Valve Seizure Prevention Control>>

Vehicles such as plug-in hybrid vehicles which do not run the engine for a long time do not have the "CS MODE driving" (purging) status (see FIG. 3) and do not become the "fuel charging" status (see FIG. 2) if the fuel is not consumed. Accordingly, the status in which the control valve 11 is closed for a long time (see FIG. 1) is maintained, and thus the control valve 11 may be seized in some cases.

When the control valve 11 is seized, it is difficult to run the large amount of evaporated fuel (vapor) to flow into the canister 13 at the time of fuel charging (see FIG. 2), so that the evaporated fuel may leak from the fuel lid 7, and it is desirable to perform seizure prevention control for preventing seizure of the control valve 11.

Also, if the engine is not run, the evaporated fuel adsorbed in the canister 13 is not purged into the intake path (not shown) in the internal combustion engine. Accordingly, when the seizure prevention control for the control valve 11 to be discussed later is executed, it is desirable to execute the seizure prevention control in a state in which the vapor path 9 communicating the fuel tank 3 with the canister 13 is closed so that no evaporated fuel in the fuel tank 3 is adsorbed in the canister 13, i.e., in a status in which the control valve 11 closes the vapor path 9.

An explanation will now be given of the seizure prevention control for the control valve 11 executed by the evaporated fuel treatment apparatus 1 of this embodiment with reference to FIG. 10.

Figure 10:
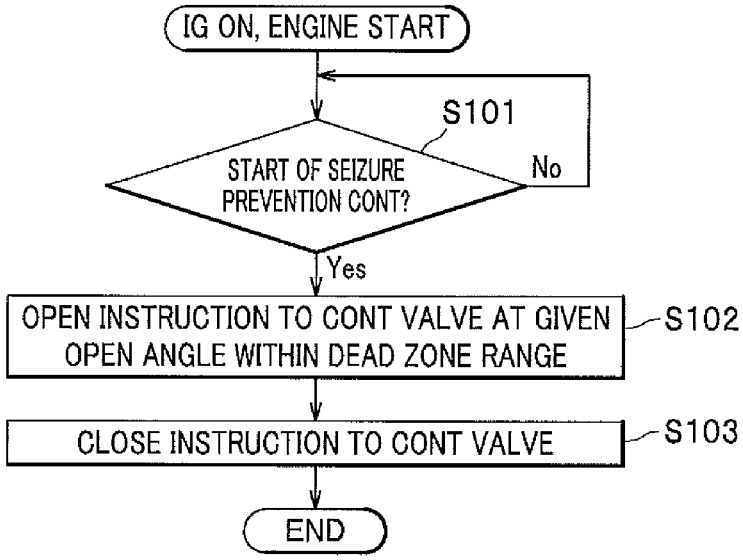
FIG. 10 is a flowchart of a seizure-prevention control of the control valve of the evaporated fuel treatment apparatus according to the fourth embodiment of the present invention.

FIG. 10 is a flowchart showing the seizure prevention control of the control valve 11 executed by the evaporated fuel treatment apparatus 1 according to this embodiment. This process starts in response to turning on of an ignition switch of the vehicle or a startup of an engine (driving force source).

First, the control unit (an open/close instruction unit) 2 determines in step S101 whether or not it is in a condition to start the seizure prevention control. When it is not in the condition to start the seizure prevention control (step S101: NO), the step S101 is repeated until it becomes a condition to start the seizure prevention control.

When it is in the condition to start the seizure prevention control (step S101: YES), the process progresses to step S102.

The condition to start the seizure prevention control may be a condition when the ignition switch of the vehicle is turned on, or may be a condition when the driving source (an engine or an EV) of the vehicle is activated. Also, a condition in which a predetermined time has elapsed after the previous operation of the control valve 11 may be the condition to start the seizure prevention control. Furthermore, when the number of times that the ignition switch is turned on becomes a predetermined number, or when the travel distance of the vehicle becomes a predetermined value, the seizure prevention control may be started.

In the step S102, the control unit (the open/close instruction unit) 2 sends an open instruction signal to the control valve 11 to open it at an angle within the dead-zone range B and generates an output value as a target opening angle.

A rotation angle set at the angle within the dead-zone range B and output by the control unit (the open/close instruction unit) 2 to the control valve 11 as the open instruction signal is referred to as an "output value".

In the step S103, the control unit 2 transmits the close instruction signal to the control valve 11 and finishes the seizure prevention control.

As explained above, according to this embodiment, the control valve 11 is operated so as to rotate within the dead-zone range B thereof, so that the control valve 11 can be prevented from being seized while the control valve 11 maintains a condition in which the vapor path 9 is closed and is not communicated between the fuel tank 3 and the canister 13, i.e., a condition in which the evaporated fuel in the fuel tank 3 is not adsorbed by the canister 13.

The present invention is not limited to the embodiments described above and may be embodied in various manners.

For example, in the embodiments, the control unit 2 performs the seizure prevention by opening and closing the control valve 11 on the basis of the instruction value specified within the dead zone range B. However the seizure prevention for the control valve 11 may be done with an actual opening angle of the control valve 11 detected by the opening angle detector 12 in place of, or in addition to the specified instruction value. This provides a surer seizure prevention control without deviation from the dead zone range B.

It is preferable that the vehicle performing the seizure prevention control explained in this embodiment should be a plug-in hybrid vehicle. According to the plug-in hybrid vehicle, traveling with the engine not being run for a long time is possible, so that the seizure prevention control on the control vale 11 is important. Hence, the seizure prevention control explained in this embodiment is preferable.

Figure 11:
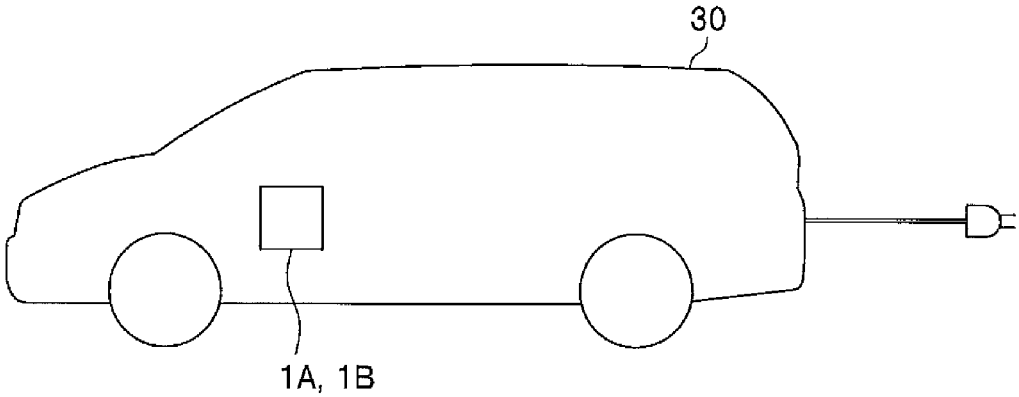
FIG. 11 is an illustration of the evaporated fuel treatment apparatus according to the first to fourth embodiments applied to a plug-in hybrid vehicle.

More specifically, as shown in FIG. 11, the seizure prevention control is applicable to a plug-in hybrid vehicle 30 having the evaporated fuel treatment apparatus 1A or 1B. In addition, the first to third embodiments are applicable to the plug-in hybrid vehicle 30.

What is claimed is:

1. An evaporated fuel treatment apparatus for a vehicle comprising:

a fuel tank configured to store a fuel;

a canister configured to adsorb evaporated fuel in the fuel tank;

a control valve, installed at a vapor path communicating with the fuel tank and the canister, including a valve element; and a control unit configured to perform opening control on the control valve, wherein the control valve has a dead-zone range in an opening angle of the valve element where a flow of the evaporated fuel is blocked even when the opening angle of the control valve is increased in an open direction from an initial position;

wherein the control unit determines whether the opening angle is switched between the dead zone range and a communicating range where the opening angle is greater than any of the opening angle in the dead zone range.

2. The evaporated fuel treatment apparatus according to claim 1, further comprising a pressure sensor configured to detect a pressure inside the fuel tank, wherein the control unit determines whether the opening angle is switched between the dead zone range and the communicating range on the basis of the detected pressure.

3. The evaporated fuel treatment apparatus according to claim 2, wherein the control unit determines that the opening angle is switched from the dead zone range to the communicating range when the pressure inside the fuel tank begins to decrease while the opening angle is increased in an opening direction of the control valve from the dead zone range.

4. The evaporated fuel treatment apparatus according to claim 3, wherein the control unit determines that the opening angle is switched from the communicating range to the dead zone range when the pressure inside the fuel tank become constant while the opening angle is decreased in a closing direction of the control value from the communicating range.

5. The evaporated fuel treatment apparatus according to claim 4, wherein the control unit decreases the opening angle in the closing direction of the control value from the communicating range at a first speed which is smaller than a second speed at which the control unit increases the opening angle in the opening direction of the control valve from the dead zone range.

6. The evaporated fuel treatment apparatus according to claim 1, further comprising an air-fuel mixture ratio sensor configured to detect an air-fuel ratio of an air-fuel mixture including the evaporated fuel, wherein the control unit determines whether the opening angle is switched between the dead zone range and the communicating range on the basis of the detected air-fuel ratio.

7. The evaporated fuel treatment apparatus according to claim 6, wherein the control unit determines that the opening angle is switched from the dead zone range to the communicating range when the air-fuel ratio decreases by a quantity greater than a predetermined quantity while the opening angle is increased in an opening direction of the control valve from the dead zone range.

8. The evaporated fuel treatment apparatus according to claim 1, further comprising an opening angle detecting unit configured to detect an opening angle of the control valve and a storage configured to store the opening angle detected by the opening angle detecting unit when the control unit determines whether the opening angle is switched between the dead zone range and the communicating range.

9. The evaporated fuel treatment apparatus according to claim 1, wherein the control unit operates the control valve in the dead zone range when the vehicle is in a predetermined condition.

10. The evaporated fuel treatment apparatus according to claim 9, wherein the control unit operates the control valve in the dead zone range when an ignition switch of the vehicle is turned on.

11. The evaporated fuel treatment apparatus according to claim 9, wherein the control unit operates the control valve in the dead zone range when a driving force source of the vehicle is started up.

12. The evaporated fuel treatment apparatus according to claim 9, wherein the evaporated fuel is not adsorbed when the opening angle is in the dead zone range.

13. The evaporated fuel treatment apparatus according to claim 9, wherein the control valve comprises a ball valve.

14. The evaporated fuel treatment apparatus according to claim 9, further comprising an opening angle detecting unit configured to detect an opening angle of the control valve.

15. The evaporated fuel treatment apparatus according to claim 1, wherein the vehicle comprises a plug-in hybrid vehicle.

* * * * *